United States Patent [19]

LaLonde

[11] Patent Number: 4,499,697

[45] Date of Patent: Feb. 19, 1985

[54] SUSPENDED CEILING WITH REMOVABLE TEE SECTIONS

[75] Inventor: Paul D. LaLonde, Lorain, Ohio

[73] Assignee: Donn Incorporated, Westlake, Ohio

[21] Appl. No.: 232,584

[22] Filed: Feb. 9, 1981

[51] Int. Cl.[3] ..... E04B 1/00; E04B 5/52

[52] U.S. Cl. ..... 52/98; 52/484; 52/721; 52/726

[58] Field of Search ..... 52/98, 484, 488, 486, 52/DIG. 5, 573, 664, 665, 667; 403/345, 346, 347

[56] References Cited

U.S. PATENT DOCUMENTS

| | | | |
|---|---|---|---|
| 876,124 | 1/1908 | Wilson | 52/667 |
| 1,744,153 | 1/1930 | Bates | 52/667 |
| 3,356,402 | 12/1967 | Smith | 52/664 |
| 4,108,563 | 8/1978 | Brown | 52/667 |
| 4,151,694 | 5/1979 | Sriberg et al. | 52/667 |
| 4,161,856 | 7/1979 | Brown | 52/667 |

*Primary Examiner*—Donald G. Kelly
*Assistant Examiner*—Michael Safavi
*Attorney, Agent, or Firm*—Pearne, Gordon, Sessions, McCoy, Granger & Tilberry

[57] ABSTRACT

A suspension ceiling grid system is disclosed in which cross members are provided with end connectors inserted from opposite sides through openings in runners extending perpendicularly thereto. The end connectors are provided with resilient lock means which interengage when the connectors are inserted into the opening to interlock the runners. Release means provided by a tab formed in the web adjacent to the opening cooperate to define a portion of the opening when in the normal position and are bendable to a release position to enlarge the opening and allow release of the lock means for removal of one or both of the end connectors.

9 Claims, 4 Drawing Figures

SUSPENDED CEILING WITH REMOVABLE TEE SECTIONS

BACKGROUND OF INVENTION

This invention relates generally to grid systems for suspension ceilings or the like, and more particularly to a novel and improved grid connector system in which removal of a grid member from an existing system can be accomplished with relative ease and without damage to the grid components.

PRIOR ART

Grid systems for suspension ceilings and the like are often assembled from grid members having connectors at their ends which extend through apertures or openings in perpendicularly extending grid members to provide an interconnection therebetween. In such systems, it is sometimes necessary to remove one or more members from an existing grid system, for example, to repair a damaged grid or to change the location of a lighting or air distribution accessory. In many instances, such removal is difficult to accomplish and often results in connector damage.

This is particularly true of systems in which connection is made by inserting a snap locking connector into an opening. One such system is described and claimed in U.S. Pat. No. 4,108,563, assigned to the assignee of the present invention.

In such patent, a grid connector system is described in which cross-tee connectors are inserted from opposite sides through an opening in the web of an associated tee. Such cross-tee connectors provide interlocking means which are deflected during insertion and then snap into locking engagement upon completion of the insertion. Once assembled, such connectors provide a relatively permanent interconnection.

Another connector system illustrated in U.S. Pat. No. 3,356,402 provides an opening defined in part by a bendable tab which is bent to a locking position during assembly to lock the connection together.

SUMMARY OF THE INVENTION

In accordance with the present invention, a novel and improved connector system is provided for suspension grid systems or the like which provides means permitting release of the connectors when required, which means do not adversely affect the permanence of the connection in normal use. The invention is illustrated as applied to the connector system of U.S. Pat. No. 4,108,563, and such patent is incorporated herein by reference.

In accordance with the illustrated embodiment of this invention, a snap lock connector is assembled by inserting one or more connectors through an opening until the connector snaps into its locked condition. In such condition, the lateral confinement provided by the opening maintains interlocking engagement and prevents removal of the connector. Means are provided, however, to permit enlargement of the opening and lateral movement of the connectors. This releases the locking connection and permits removal of the grid members.

The enlargement of the opening is accomplished by bending back a tab that provides a portion of the opening boundary. After removal of the connector, the tab is bent back to its original position and subsequent connections can be accomplished in the normal manner.

With this invention, novel and improved means are provided to allow the easy removal of a grid member from an existing grid system without damage to the parts of the system.

These and other aspects of this invention are more fully described in the following description and drawings.

DETAILED DESCRIPTION OF THE DRAWINGS

The present invention is illustrated as applied to a grid connecting system for suspension ceilings of the type described in detail and claimed in U.S. Pat. No. 4,108,563, to Brown et al granted Aug. 22, 1978, and reference should be made to such patent for a more detailed description of the exact structure of the connection system and the manner in which it functions. It should be understood, however, that the present invention in its broader aspects is not limited to the particular connection system illustrated, and can be applied with equal facility to some other types of connection systems.

Figure 1:
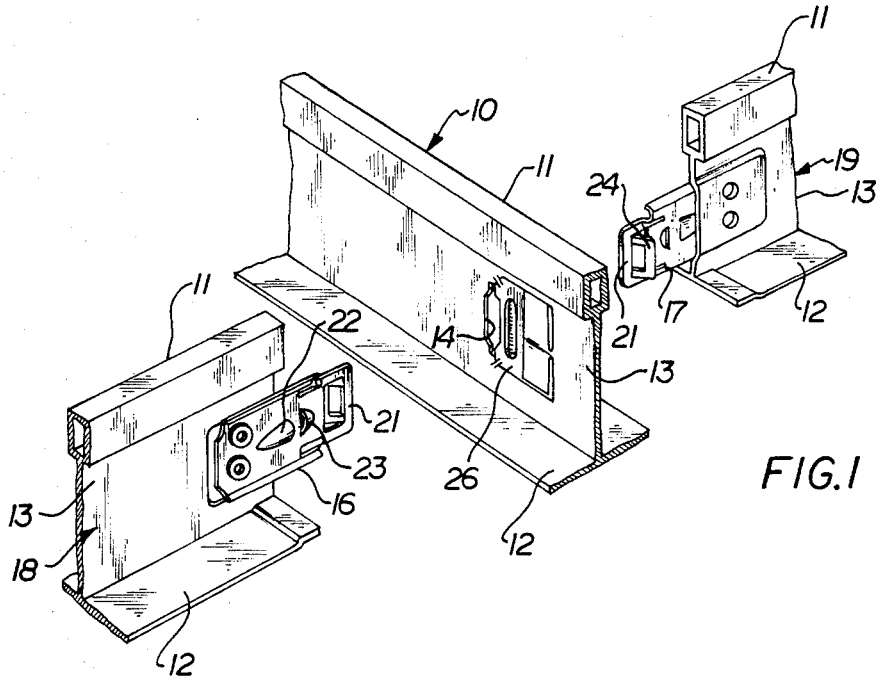
FIG. 1 is a fragmentary, perspective view of a connector system incorporating this invention, illustrating a portion of a main run member and the ends of two associated cross members before the end connectors are inserted into the web opening in the main member.
Figure 2:
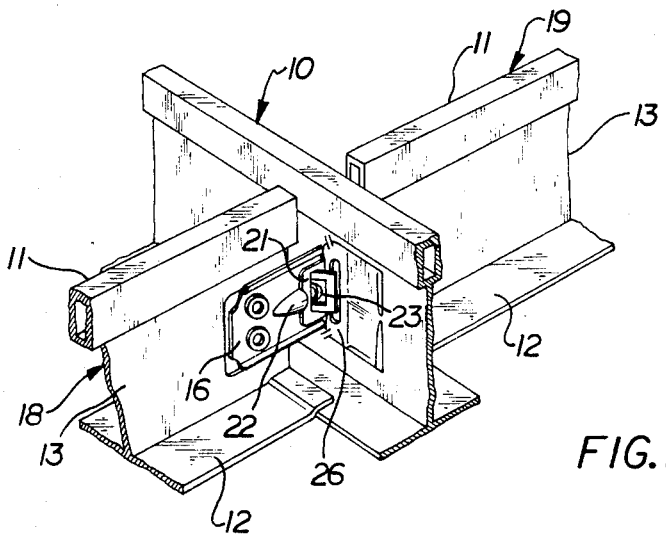
FIG. 2 is a perspective view similar to FIG. 1, illustrating both end connectors in the fully installed position.
Figure 3:
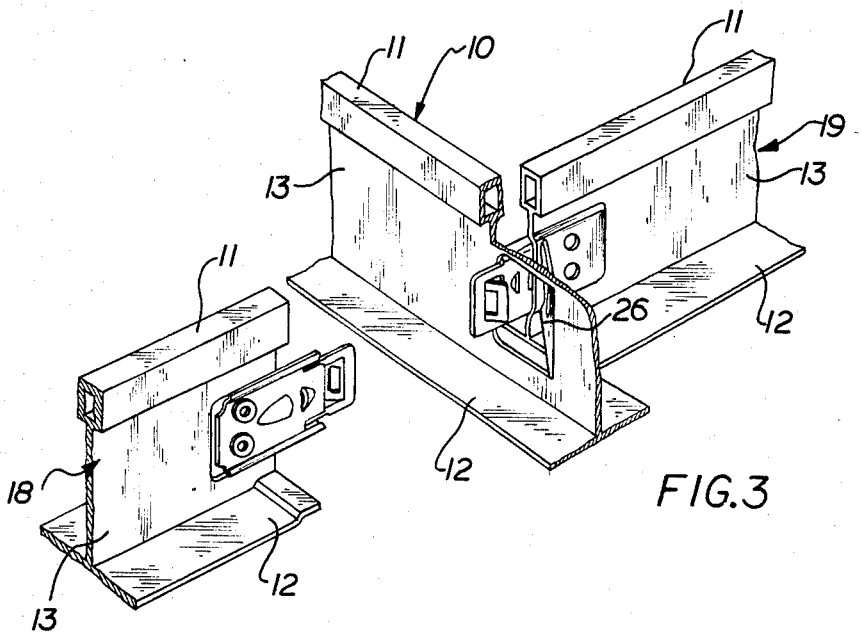
FIG. 3 is a perspective view similar to FIG. 2, but illustrating the release tab after it is bent back to enlarge the size of the opening and allow lateral separation of the end connectors and disassembly of the grid members.

Referring to FIGS. 1 through 3, the connection system includes a first runner 10, which may be a main run member or a cross-run member, as the case may be, and two cross-run members 18 and 19. All of such members have a generally tee-shape providing a bulb 11 at their upper edges, a flange 12 at their lower edges, and a central web 13 intermediate the bulbs and flanges. The web of the member 10 is provided with a shaped opening 14 through which end connectors 16 and 17 are inserted during the assembly of the grid. The end connector 16 is mounted on the end of a cross-tee 18, and the end connector 17 is mounted on the end of a cross-tee 19. The two end connectors 16 and 17 are structured to be inserted from opposite sides through the opening 14 to an assembled condition illustrated in FIG. 2.

In such condition, a strap portion 21 on each connector is positioned between a pair of opposed projections 22 and 23 on the other connector. During insertion, the parts 21 are deflected laterally as the straps 21 pass the projections 23 and resiliently return to a substantially unstressed condition in which the straps are located between the associated projections 22 and 23, as illustrated in FIG. 2. With this structure, a connection is provided between the two connectors 16 and 17 on both sides of the web 13.

Each of the connectors is also provided with a laterally extending projection 24 which is deflected during insertion and operates when only one connector is positioned within an opening to engage the web adjacent the opening to maintain the connector in position even when a second connector is not installed. Therefore, the particular embodiment of connector illustrated can be installed singly from either side of the web 13, or two connectors can be inserted into a signal opening to provide an assembly as illustrated in FIG. 2. The particular connector provides an interconnection between the two members 18 and 19 which maintains their axial positioning independent of the thickness of the web 13.

When the system is assembled, the sidewalls of the opening 14 function to prevent lateral separation of the connectors and maintain the straps 21 between the associated projections 22 and 23. Therefore, this lateral confinement produces a substantially permanent connection. Also, the web adjacent to the opening is engageable by the projection 24 to prevent removal of the connector.

In some instances, after a grid is assembled, it is desirable to remove one or more runners. It is therefore desirable to provide a simple mechanism allowing removal of such runner.

Figure 4:
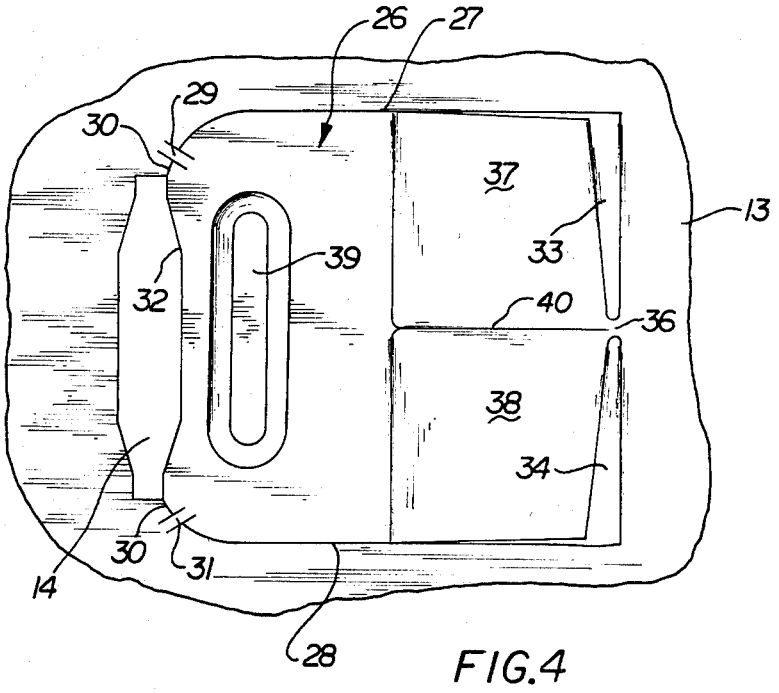
FIG. 4 is a fragmentary side elevation of the main run member, illustrating the structural detail of the release tab.

In the present invention, the web 13 is provided with a tab 26 which, in its normal position, cooperates to define one side of the opening 14. Such tab is best illustrated in FIG. 4, and is formed by piercing the web 13 adjacent to the opening 14, as illustrated. The tab has similar upper and lower edge cuts 27 and 28 which extend to frangible connections 29 and 31, respectively. The frangible connections 29 and 31 are located substantially adjacent to the end 32 of the tab 26, which is shaped to provide one side boundary of the opening 14. Between the connections 29 and 31, the web is also pierced to form cuts 30 which intersect corners of the opening 14. At the end of the tab 26 remote from the end 32, sections 33 and 34 are cut out, leaving an integral center connection 36. The tab 26 and opening 14 are preferably die-cut during the manufacture of the member 10, in a manner which displaces the tab edges along the top and bottom cuts 27 and 28, respectively, back from the plane of the web as viewed in FIG. 4. In the illustrated form, the tab is also provided with a shallow V-shape having portions 37 and 38 which extend back from the plane of the web a slight amount, leaving a center or junction of the V at 40 substantially in the plane of the web.

After initial piercing, the tab is ironed back to some extent into the plane of the web 13 so that the edges formed during the piercing operation engage the adjacent web portions. During such subsequent operation, it is preferable to provide a shallow recess section at 39 which assists in locating the end of a screwdriver or the like when it is desired to bend the tab 26 back to enlarge the opening and allow removal of the connectors 16 and/or 17 from the opening.

The frangible sections 29 and 31 are formed by parallel cuts extending substantially perpendicular to the edges of the tab, and provide an integral connection between the web 13 proper and the end of the tab 26 adjacent to the opening 32.

When the tab is formed in this manner, the engaging edges, in cooperation with the frangible sections 29 and 31, resist deflection of the tab adjacent to the opening 14 when the end connectors 16 and 17 are inserted into the opening. Further, the structure is arranged so that the tab is located on the side of the opening 14 through which the connector 17 is inserted during assembly of the system, and so that the tab provides more resistance to deflection or bending in the direction of the insertion of the connector 17 than resistance to deflection or bending back in the opposite direction. Such resistance to bending in the direction of insertion of the adjacent connector 17 is selected to be sufficiently large so that the tab remains in position when the connector 17 is inserted during assembly of the system.

However, the resistance to bending of the tab in the opposite direction, back from the plane of the web as illustrated in FIG. 3, is smaller. Therefore, it is not difficult to bend the tab 26 back by merely positioning the end of a screwdriver or the like in the shallow recess 39 and pressing on the tab until it bends back from the plane of the web to a position such as that illustrated in FIG. 3. Such bending of the tab, of course, causes the frangible connections 29 and 31 to break and, in effect, causes the tab to pivot back about a hinge connection provided at 36.

When the tab is bent back as illustrated in FIG. 3, the opening 14 is laterally enlarged, allowing the two end connectors to be moved laterally apart to move the strap portions 21 from between the associated projections 22 and 23. This disconnects the two end connectors and allows removal, as illustrated in FIG. 3. Either or both of the end connectors can be removed from the opening at such time. In instances in which only one connector is located in the opening, the bending of the tab to the release position which opens the opening, provides clearance for the projection, allowing removal of such a connector.

After the selected end connector is removed, the tab 26 is then bent back to its original position in which it coincides substantially with the plane of the web 13 to reestablish the original size and shape of the opening 14. Thereafter, end connectors can be again assembled through the opening in the original manner. It is recognized that when the tab is returned to its original position, the frangible sections no longer provide an integral connection adjacent the opening. However, the engagement of the edges of the tab with the mating edges of the web provides sufficient resistance to movement of the tab forward of the plane of the web, as viewed in FIG. 4, to allow insertion of a subsequent connector 17.

Because the tab 26 is formed from the material of the web 13 which already exists, the provision of the releasing mechanism provided by the tab does not require any additional material. Further, since the tab is formed by the simple expediency of die cutting and working, it does not cause any material increase in the cost of producing the runner.

With the present invention, a connecting system is provided which is substantially permanent in normal use of the grid, and grid assembly is accomplished in exactly the same way as it would be done in the absence of the means for allowing easy removal of a given runner from the grid. It is only when it is required to remove a given connector that the tab is bent back to allow such easy removal. With this invention, therefore, the normal assembly of the grid system is not changed in any way and the strength of the connection is not affected in normal use.

Although the preferred embodiment of this invention has been shown and described, it should be understood that various modifications and rearrangements of parts may be resorted to without departing from the scope of the invention as disclosed and claimed herein.

What is claimed is:

1. A connector system for grid systems comprising a first elongated member having a substantially planar web formed with an opening therein, said web providing release means movable from a first position substantially in said plane of said web to a second position out of the plane of said web, said release means when in said first position defining at least part of said opening, a second elongated member having a first end connector operable to be inserted lengthwise into said opening while said release means is in said first position, and providing laterally extending deflectable first lock means which deflect during said insertion and interlock said members when inserted, said opening being of a size to allow the end connector to pass fully therethrough with said lock means deflected, movement of said release means to said second position enlarging said opening and permitting release of said lock means for withdrawal of said first end connector from said opening.

2. A connector system as set forth in claim 1, wherein a third elongated member is provided with a second end connector insertable into said opening while said release means is in said first position from the opposite side thereof, said second end connector providing second lock means interconnecting with said first and second members and being releasable when said release means is in said second position and said opening is enlarged.

3. A connector system as set forth in claim 2, wherein said release means is formed by piercing said web to form a tab which is bendable to enlarge said opening.

4. A connector system as set forth in claim 3, wherein said tab is normally retained in position by frangible connections, said frangible connections being broken when said tab is bent to enlarge said opening.

5. A connector system as set forth in claim 4, wherein said tab is formed to provide substantial resistance to movement in one direction and less resistance to movement in the opposite direction, and insertion of said end connectors does not produce substantial force on said tab in said opposite direction.

6. A connector system as set forth in claim 2, wherein said tab is formed to provide substantial resistance to movement in one direction and less resistance to movement in the opposite direction, and insertion of said end connectors does not produce substantial force on said tab in said opposite direction.

7. A suspension ceiling grid system comprising a plurality of parallel first runs, a plurality of second runs interconnected at intersections with said first runs and extending perpendicularly thereto, said first runs providing connector openings at the intersections with said second runs, said second runs including a plurality of aligned runners having end connector extending through associated ones of said openings from opposite sides thereof, said end connector having locked means which resist removal of said end connector from said opening, said openings providing lateral confinement of said end connectors causing said lock means to remain operative, and release means operable from a normal position to release position to enlarge said openings and allow lateral separation of said end connectors to release said lock means for removal of associated runners, said end connectors being insertable in said openings while said release means is in said normal position, said first runs are formed with a web, said opening is formed in said web, and said release means is a tab cut from said web, the end of said tab when in said normal position defining a lateral side of said opening, said tab in said normal position being substantially in a plane of said web, said tab being bendable to said release position, said opening being of a size to allow the end connectors to pass fully therethrough.

8. A suspension ceiling grid system as set forth in claim 7, wherein said tab and web are connected by a frangible section which breaks when said tab is moved to said release position.

9. A suspension ceiling as set forth in claim 8, wherein said tab is formed with means to position a tool for bending said tab to said release position.

* * * * *